US009306274B2

(12) United States Patent
Tayama et al.

(10) Patent No.: US 9,306,274 B2
(45) Date of Patent: Apr. 5, 2016

(54) ANTENNA DEVICE AND ANTENNA MOUNTING METHOD

(71) Applicant: FUJIKURA LTD., Tokyo (JP)

(72) Inventors: Hiroiku Tayama, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 182 days.

(21) Appl. No.: 14/158,312

(22) Filed: Jan. 17, 2014

(65) Prior Publication Data

US 2014/0132471 A1 May 15, 2014

Related U.S. Application Data

(63) Continuation of application No. PCT/JP2012/071366, filed on Aug. 23, 2012.

(30) Foreign Application Priority Data

Sep. 26, 2011 (JP) ..... 2011-209640

(51) Int. Cl.

| | |
|---|---|
| ***H01Q 1/48*** | (2006.01) |
| ***H01Q 1/38*** | (2006.01) |
| ***H01Q 9/42*** | (2006.01) |
| ***H01Q 1/22*** | (2006.01) |

(52) U.S. Cl.

CPC . *H01Q 1/48* (2013.01); *H01Q 1/22* (2013.01); *H01Q 1/38* (2013.01); *H01Q 9/42* (2013.01); *Y10T 29/49018* (2015.01)

(58) Field of Classification Search

CPC ..... H01Q 1/48; H01Q 1/22; H01Q 1/38; H01Q 1/42; Y10T 29/49018

See application file for complete search history.

(56) References Cited

U.S. PATENT DOCUMENTS

| | | | | |
|---|---|---|---|---|
| 7,602,343 | B2 * | 10/2009 | Takada | H01Q 1/243 343/700 MS |
| 8,373,600 | B2 * | 2/2013 | Chang | H01Q 1/243 343/700 MS |
| 2005/0024268 | A1 * | 2/2005 | McKinzie | H01Q 9/0421 343/700 MS |
| 2006/0119517 | A1 | 6/2006 | Futamata | |
| 2009/0115664 | A1 * | 5/2009 | Chung | H01Q 1/243 343/700 MS |
| 2010/0149065 | A1 * | 6/2010 | Wong | H01Q 5/00 343/848 |

(Continued)

FOREIGN PATENT DOCUMENTS

| | | | |
|---|---|---|---|
| CN | 1720640 | A | 1/2006 |
| CN | 2838056 | Y | 11/2006 |

(Continued)

OTHER PUBLICATIONS

Decision to Grant a Patent dated Feb. 3, 2015, issued in corresponding Japanese Patent Application No. 2013-536088 (3 pages).

Chinese Office Action dated Oct. 17, 2014, issued in corresponding CN application No. 201280036512.2 with English translation (32 pages).

(Continued)

*Primary Examiner* — Trinh Dinh

(74) *Attorney, Agent, or Firm* — Westerman, Hattori, Daniels & Adrian, LLP

(57) ABSTRACT

An antenna device (10) includes: an antenna (100) including a radiating element (101) and an internal ground (103); a coaxial cable (200) whose internal conductor (204) is connected with the radiating element (101) and whose external conductor (203) is connected with the internal ground (103); and an external ground (500) connected with the external conductor (203) of the coaxial cable (200).

7 Claims, 8 Drawing Sheets

(56) References Cited

U.S. PATENT DOCUMENTS

| | | | | |
|---|---|---|---|---|
| 2012/0299785 | A1* | 11/2012 | Bevelacqua | H01Q 9/42 343/702 |
| 2012/0306721 | A1* | 12/2012 | Okegawa | H01Q 9/0421 343/905 |

FOREIGN PATENT DOCUMENTS

| | | | |
|---|---|---|---|
| CN | 101615718 | A | 12/2009 |
| JP | 11-274843 | A | 10/1999 |
| JP | 2002-158535 | A | 5/2002 |
| JP | 2002-280825 | A | 9/2002 |
| JP | 2007-14021 | A | 1/2007 |
| JP | 2007-166127 | A | 6/2007 |
| JP | 2009-55299 | A | 3/2009 |

OTHER PUBLICATIONS

Cheng-Tse Lee et al., "Uniplanar Printed Coupled-Fed PIFA With a Band-Notching Slit for WLAN/WiMAX Operation in the Laptop Computer",IEEE Transactions on Antennas and Propagation, Apr. 2009, vol. 57, No. 4, pp. 1252-1258, cited in Chinese Office Action dated Oct. 17, 2014 (7 pages).

Japanese Office Action dated Nov. 4, 2014, issued in corresponding JP Application No. 2013-536088 with English translation (6 pages).

International Search Report dated Oct. 2, 2012, issued in corresponding application No. PCT/JP2012/071366.

Notification of Transmittal of Translation of the International Preliminary Report on Patentability (Form PCT/IB/338) of International Application No. PCT/JP2012/071366 mailed Apr. 10, 2014 with Forms PCT/IB/373 and PCT/ISA/237 (6 pages).

* cited by examiner

ANTENNA DEVICE AND ANTENNA MOUNTING METHOD

CROSS-REFERENCE TO RELATED APPLICATIONS

This application is a Continuation of PCT International Application No. PCT/JP2012/071366 filed in Japan on Aug. 23, 2012, which claims the benefit of Patent Application No. 2011-209640 filed in Japan on Sep. 26, 2011, the entire contents of which are hereby incorporated by reference.

TECHNICAL FIELD

The present invention relates to an antenna device for wireless communications. Furthermore, the present invention relates to a method for mounting an antenna on a wireless device.

BACKGROUND ART

Recently, small wireless devices such as mobile phones have been prevailing rapidly, and there is a requirement for small and wideband antennas to be mounted on such wireless devices. An example of an antenna capable of meeting such a requirement is a monopole antenna.

The monopole antenna is an antenna including a radiating element connected with an internal conductor of a coaxial cable and a ground (also referred to as "bottom board") connected with an external conductor of the coaxial cable. In particular, a monopole antenna including a short-circuit section which short-circuits a radiating element and a ground is called an inverted F antenna. Such a monopole antenna can reduce the entire length of a radiating element to approximately ¼ of an operating wavelength, and accordingly is advantageous in terms of downsizing compared to a dipole antenna operating at the same band (whose radiating element is required to have an entire length of approximately ½ of an operating wavelength).

Known examples of a technique for further downsizing the monopole antenna without limiting an operating band are described in, for example, Patent Literatures 1 and 2. Patent Literature 1 discloses an inverted F antenna in which a radiating element (element part) is turned back so as to be downsized. Patent Literature 2 discloses an inverted F antenna in which a ground (second conductor) is notched so as to reduce the area of a bottom board.

CITATION LIST

Patent Literature 1

Japanese Patent Application Publication No. 2009-55299 (published on Mar. 12, 2009)

Patent Literature 2

Japanese Patent Application Publication No. 2007-166127 (published on Jun. 28, 2007)

SUMMARY OF INVENTION

Technical Problem

However, the inverted F antenna described in Patent Literature 1 has a ground (GND part) with a very large area. As above, a conventional monopole antenna (including an inverted F antenna) requires a ground with a very large area (ideally, limitless area), which makes it difficult to downsize the antenna.

In contrast, the inverted F antenna described in Patent Literature 2 is designed to have a notched ground (second conductor), which allows the ground to be smaller than a conventional one. However, the ground still has a larger area than a radiating element (first conductor). Thus, the existence of the ground makes it difficult to downsize the antenna.

In a case where an antenna cannot be downsized, a wireless device on which the antenna is to be mounted is required to have a large space to contain the antenna. Consequently, the problem that an antenna cannot be downsized has an adversely affect the design of a wireless device on which the antenna is to be mounted.

In particular, wireless devices such as smart phones and electronic book readers have come to have a larger display panel, which narrows a space around the display panel used for containing an antenna. Enlarging the space in order to mount an antenna thereon is not preferable in terms of design. Consequently, an antenna is required to be further downsized so that the antenna can be mounted on such a narrow space.

The present invention was made in view of the foregoing problem. An object of the present invention is to realize an antenna device which can be mounted on a narrower space than a conventional one without limiting an operating band.

Solution to Problem

In order to solve the foregoing problem, an antenna device of the present invention includes: an antenna including a radiating element and an internal ground; a coaxial cable whose internal conductor is connected with the radiating element and whose external conductor is connected with the internal ground; and an external ground connected with the external conductor of the coaxial cable.

With the arrangement, both of the internal ground and the external ground serve as a ground (bottom board) which is an essential component of a monopole antenna (including an inverted F antenna). Therefore, for example, by using, as the external ground, a substrate originally included in a wireless device including the antenna device, it is possible to reduce the area of the internal ground without limiting a function of a monopole antenna. This allows realizing an antenna whose mounting area is smaller than that of a conventional antenna.

An antenna mounting method of the present invention is an antenna mounting method for mounting, on a wireless device, an antenna including a radiating element and an internal ground, said antenna mounting method comprising the steps of: connecting an internal conductor of a coaxial cable with the radiating element and connecting an external conductor of the coaxial cable with the internal ground; and connecting the external conductor of the coaxial cable with an external ground included in the wireless device.

With the antenna mounting method, both of the internal ground and the external ground serve as a ground (bottom board) which is an essential component of a monopole antenna (including an inverted F antenna). Therefore, for example, by using, as the external ground, a substrate originally included in the wireless device, it is possible to reduce the area of the internal ground to be mounted on the wireless device, without limiting a function of a monopole antenna. This allows mounting, on the wireless device, an antenna whose mounting area is smaller than that of a conventional antenna.

Advantageous Effects of Invention

Since the antenna device and the antenna mounting method of the present invention employ a configuration in which both of the internal ground and the external ground serve as a ground, it is possible to minimize the area of the internal ground without limiting a function of a monopole antenna. That is, by employing the present invention, it is possible to realize an antenna device which can be provided on a narrower space compared to a conventional antenna device, without limiting an operating band.

DESCRIPTION OF EMBODIMENTS

The following description will discuss an embodiment of the present invention with reference to drawings.

(Outline of Antenna Device 10)

Figure 1:
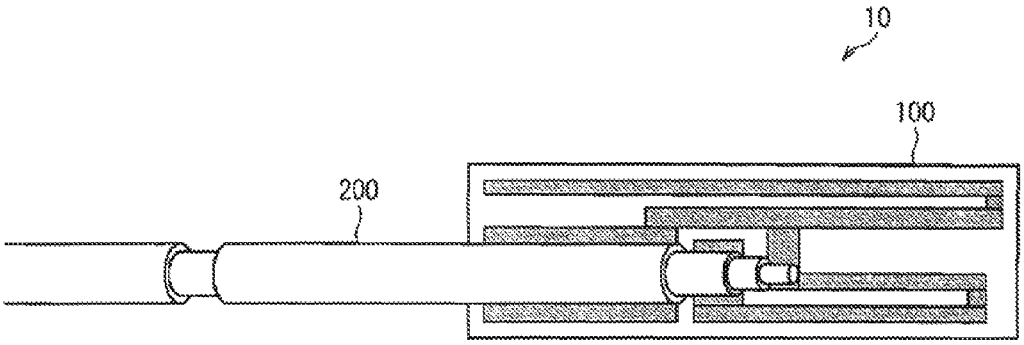
FIG. 1 is a view illustrating a configuration of an antenna device in accordance with an embodiment.

Initially, with reference to FIG. 1, a description will be provided below as to an outline of an antenna device 10 in accordance with an embodiment. FIG. 1 is a view illustrating a configuration of the antenna device 10 in accordance with the embodiment.

As illustrated in FIG. 1, the antenna device 10 includes an antenna 100 and a coaxial cable 200. As described later, the antenna 100 is an inverted F antenna formed on a single plane.

The antenna device 10 is for use in wireless devices such as smart phones, mobile phones, electronic book readers, laptop computers, and PDAs, and is employed to carry out wireless communication functions such as data communications, phone calls, and GPS.

(Configuration of Coaxial Cable 200)

Figure 2:
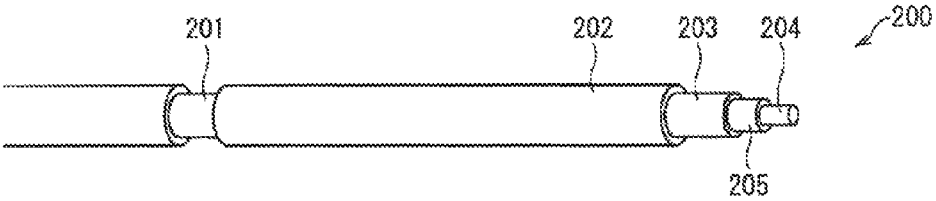
FIG. 2 is a view illustrating a configuration of a coaxial cable in accordance with the embodiment.

With reference to FIG. 2, a description will be provided below specifically as to a configuration of the coaxial cable 200 in accordance with the embodiment. FIG. 2 is a view illustrating the configuration of the coaxial cable 200 in accordance with the embodiment.

The coaxial cable 200 includes an internal conductor 204, an insulator 205, an external conductor 203, and a coverture 202 which are concentrically provided in this order from the inner side toward the outer side of the coaxial cable 200 (see FIG. 2).

The internal conductor 204 is soldered, welded, or otherwise fastened to one power supply point P (see FIG. 3) of the antenna 100, thereby causing them to be electrically connected with each other. The external conductor 203 is soldered, welded, or otherwise fastened to the other power supply point Q (see FIG. 3) of the antenna 100, thereby causing them to be electrically connected with each other.

The insulator 205 is provided for electrically insulating the internal conductor 204 from the external conductor 203. The coverture 202 is provided for (i) protecting the external conductor 203 and (ii) electrically insulating the external conductor 203 from outside. For this reason, the coverture 202 is made of an insulator.

(Exposing Part 201)

The coaxial cable 200 further includes an exposing part 201. The exposing part 201 is a part which is located to be away, by a certain distance, from a leading end of the coaxial cable 200. Such a part is obtained by partially stripping the coverture 202. The exposing part 201 is provided for exposing the external conductor 203 of the coaxial cable 200 so that the external conductor 203 is electrically connected with a ground (see, for example, a substrate 500 in FIG. 5) provided outside. This allows the antenna 100 to use the substrate 500 as an external ground.

The coaxial cable 200 extends to an RF module (not illustrated) from the antenna 100, via a surface of the substrate 500 (see FIG. 5) serving as an external ground. That is, a part of the coaxial cable 200 is located on the surface of the substrate 500. The exposing part 201 is provided on such a part. This allows the external conductor 203 of the coaxial cable 200 to be electrically connected with the substrate 500.

Capacitance of capacitive coupling between the antenna 100 and the coaxial cable 200 changes depending on where the exposing part 201 is located on the coaxial cable 200. This results in a change in resonance point caused by inductance and the above capacitance between the antenna 100 and the coaxial cable 200. It is therefore possible to appropriately place the exposing part 201, depending on a desired operating band.

(Configuration of Antenna 100)

Figure 3:
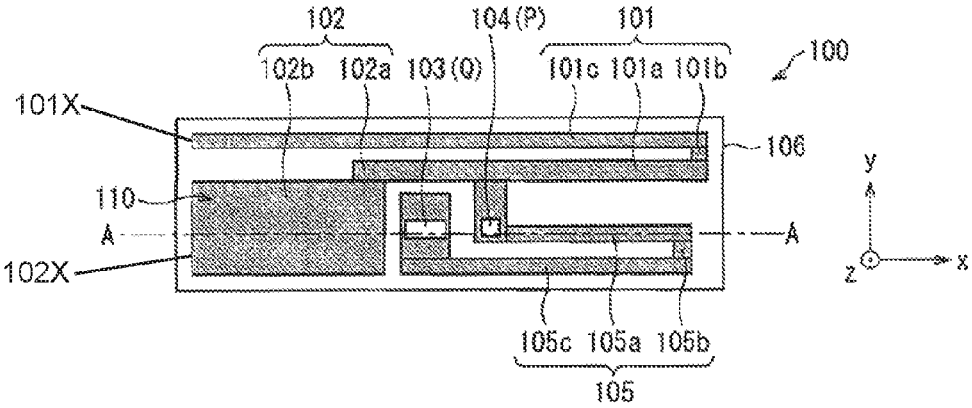
FIG. 3 is an elevation view illustrating a configuration of an antenna in accordance with the embodiment.
Figure 4:
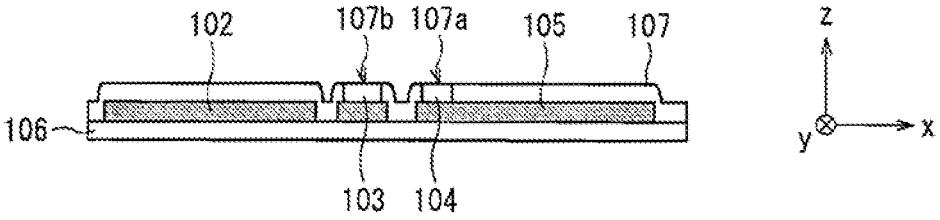
FIG. 4 is a cross sectional view taken along line A-A of the antenna in FIG. 3.

Next, the following description will discuss specifically a configuration of the antenna 100 in accordance with the present embodiment, with reference to FIGS. 3 and 4. FIG. 3 is an elevation view illustrating the configuration of the antenna 100 in accordance with the embodiment. FIG. 4 is a cross sectional view taken along line A-A of the antenna 100 in FIG. 3.

As illustrated in FIG. 3, the antenna 100 includes a radiating element 101, an inductance matching section 102, an internal ground 103, a power supply section 104, a short-circuit section 105, and a dielectric substrate 106.

The radiating element 101, the inductance matching section 102, the internal ground 103, the power supply section 104, and the short-circuit section 105 (hereinafter collectively referred to as "thin film conductor section 110") are provided to be integrated with each other, by subjecting, to pressing, etching etc., a material such as aluminum and copper which has a thin film shape and electrical conductivity.

The thin film conductor section 110 is provided on the surface of the dielectric substrate 106 so as to overlap the dielectric substrate 106. The thin film conductor section 110 is adhered to the dielectric substrate 106. The dielectric substrate 106 is made of a material such as a thin polyimide film.

(Specific Shape of Thin Film Conductor Section 110)

The power supply section 104 is provided at substantially the center of a plane of the thin film conductor section 110. The radiating element 101 and the short-circuit section 105 extend from the power supply section 104 in a direction (x-axis forward direction in FIG. 3) opposite to a direction in which the coaxial cable 200 is drawn out. The radiating element 101 and the short-circuit section 105 are drawn out substantially parallel to each other and substantially linearly.

The radiating element 101 is a radiating element intended to operate at a predetermined operating band (e.g. 2412 MHz-2482 MHz band which is a frequency band of Wi-Fi). For this purpose, the radiating element 101 has a length required for operation within the predetermined operating band (approximately a length of ¼ of wavelength λ).

That is, the operating band of the antenna 100 is determined also by the length of the radiating element 101. For example, in a case of shifting the operating band of the antenna 100 toward a low frequency side, it is necessary to adjust the length of the radiating element 101 to be longer. In contrast, in a case of shifting the operating band of the antenna 100 toward a high frequency side, it is necessary to adjust the length of the radiating element 101 to be shorter.

In this case, it is preferable to also adjust the length of the short-circuit section 105 so that a resonance point of the antenna 100 and a resonance point of the short-circuit section 105 are in line with each other. This is because the operating band of the antenna 100 is determined also by the length of the short-circuit section 105. As such, in a case of adjustment of only one of the lengths of the radiating element 101 and the short-circuit section 105, the resonance point of the antenna 100 and the resonance point of the short-circuit section 105 may no longer be in line with each other. This may cause the operating band to be narrow.

The short-circuit section 105 short-circuits the power supply section 104 and the internal ground 103 so that input impedance of the antenna 100 is changed (i.e. a reactance component(s) is cancelled). This allows impedance matching to be easily carried out particularly in a high frequency band.

In particular, for the purpose of widening the operating band and improving a radiation efficiency, the length of the short-circuit section 105 (i.e. the length between the power supply section 104 and the internal ground 103) is set to a length required for an operation in a predetermined operating band (approximately a length of ¼ of wavelength λ), similarly with the radiating element 101.

The radiating element 101 includes (i) a straight line section 101*a* (first straight line section) extending from the power supply section 104 in a direction (x-axis forward direction in FIG. 3) opposite to a direction in which the coaxial cable 200 is drawn out and (ii) a straight line section 101*c* (second straight line section) connected with an end of the straight line section 101*a* (an end of the straight line section 101*a* which end is farther from the power supply section 104) via an intermediary section 101*b* (first intermediary section) and extending in the direction in which the coaxial cable 200 is drawn out (x-axis backward direction in FIG. 3). Furthermore, the short-circuit section 105 includes (i) a straight line section 105*a* (third straight line section) extending from the power supply section 104 in the direction (x-axis forward direction in FIG. 3) opposite to the direction in which the coaxial cable 200 is drawn out; and (ii) a straight line section 105*c* (fourth straight line section) connected with an end of the straight line section 105*a* (an end of the straight line section 105*a* which end is farther from the power supply section 104) via an intermediary section 105*b* (second intermediary section) and extending in the direction in which the coaxial cable 200 is drawn out (x-axis backward direction in FIG. 3).

That is, each of the radiating element 101 and the short-circuit section 105 has an intermediary structure, and has a meander shape. In particular, the short-circuit section 105 short-circuits (i) the power supply section 104 containing the power supply point P and (ii) the internal ground 103 containing the power supply point Q, thereby forming a loop for impedance matching.

What is noteworthy in the antenna 100 in accordance with the present embodiment is that the internal ground 103 is made of minute conductor fragments. To be more specific, the internal ground 103 is made of rectangular conductor fragments, one side of each of which has a length substantially equal to a diameter of the coaxial cable 200. The internal ground 103 can be made of such minute conductor fragments because the substrate 500, electrically connected with the external conductor 203 of the coaxial cable 200, serves as a ground.

(Inductance Matching Section 102)

The inductance matching section 102 is provided for capacitive-coupling the antenna 100 and the coaxial cable 200. As a result of the capacitance coupling, the antenna device 10 causes inductance to occur between the antenna and the coaxial cable. By making use of a resonance at a resonance point of the inductance, it is possible for the antenna device 10 to widen the operating band and improve the radiation characteristics.

Specifically, the inductance matching section 102 includes a straight line section 102*a* and a pattern 102*b*. The straight line section 102*a* extends from the power supply section 104 in the direction in which the coaxial cable 200 is drawn out. The pattern 102*b* is connected with the straight line section 102*a*, has a rectangular shape, and is provided so as to overlap the coaxial cable 200. By providing the coaxial cable 200 on the pattern 102*b*, the coaxial cable 200 is capacitive-coupled with the antenna 100.

As in the example illustrated in FIG. 1, it is preferable to set a width of the pattern 102*b* to larger than a width (diameter) of the coaxial cable 200 provided on the pattern 102*b*. Furthermore, as in the examples illustrated in FIGS. 1 and 3, it is preferable that a leading end 102*x* of the pattern 102*b* and a leading end 101*x* of the radiating element 101 (i.e. ends of the pattern 102*b* and the radiating element 101 in the direction in which the coaxial cable 200 extends (x-axis backward direction, in which the coaxial cable 200 is drawn out, in FIG. 5)) are juxtaposed.

(Dielectric Coating Film 107)

As illustrated in FIG. 4, the antenna 100 further includes a dielectric coating film 107. Similarly with the dielectric substrate 106, the dielectric coating film 107 is made of a member such as a thin polyimide film. The dielectric coating film 107 overlaps the thin film conductor section 110 so as to coat the thin film conductor section 110. The dielectric coating film 107 is attached to the thin film conductor section 110 and the dielectric substrate 106. Thus, the antenna 100 is configured such that the thin film conductor section 110 is sandwiched between the dielectric substrate 106 and the dielectric coating film 107.

The dielectric coating film 107 has an opening 107*a* which faces the power supply section 104. The internal conductor 204 of the coaxial cable 200 is electrically connected with the power supply section 104, via the opening 107*a*. Furthermore, the dielectric coating film 107 has an opening 107*b* which faces the internal ground 103. The external conductor 203 of the coaxial cable 200 is electrically connected with the internal ground 103, via the opening 107*b*.

(How to Provide Antenna Device 10 on Wireless Device)

Figure 5:
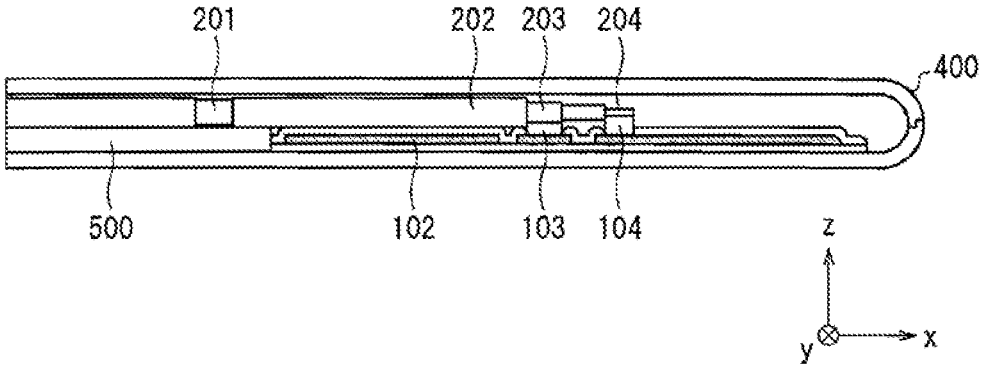
FIG. 5 is a cross sectional view illustrating an example of mounting an antenna device in accordance with the embodiment.

With reference to FIG. 5, the following description will discuss how to provide the antenna device 10 on a wireless device. FIG. 5 is a cross sectional view illustrating an example of mounting the antenna device 10 in accordance with the embodiment. In the example illustrated in FIG. 5, the antenna device 10 is provided inside a housing 400 constituting the wireless device.

Specifically, the substrate 500 is provided inside the housing 400. The substrate 500 is provided appressed to the housing 400, and is electrically connected with the housing 400. The antenna 100 of the antenna device 10 is provided on an internal surface of the housing 400, and the coaxial cable 200 of the antenna device 10 is provided on the substrate 500.

The coaxial cable 200 is provided between the antenna 100 and an RF module (not illustrated), and one end of the coaxial cable 200 is connected with the antenna 100 (internal ground 103 and power supply section 104) and the other end of the coaxial cable 200 is connected with the RF module. According to the configuration, as illustrated in FIGS. 1 and 5, a part of the coaxial cable 200 which part is closer to the antenna 100 is provided on the substrate 500 so as to extend linearly from the power supply section 104 in a direction (x-axis backward direction in FIG. 5) opposite to a direction in which the short-circuit section 105 extends and to be substantially parallel to the radiating element 101 and the short-circuit section 105. Such configuration is employed in order to avoid interference between the coaxial cable 200 and the short-circuit section 105 (impedance matching pattern) and avoid such interference from making characteristics of the antenna device 10 unstable.

In particular, a first part of the coaxial cable 200, which part is a part of the coaxial cable 200, is provided on the pattern 102*b* formed at an end of the inductance matching section 102. This causes the coaxial cable 200 and the antenna 100 to be capacitive-coupled with each other.

A second part of the coaxial cable 200, which part is closer to the RF module than the first part is, is provided on the substrate 500. The exposing part 201 is provided in the second part, via which exposing part 201 the external conductor 203 of the coaxial cable 200 is electrically connected with the substrate 500. This allows the antenna 100 to use the substrate 500 as an external ground.

The coaxial cable 200 is further fixed onto the inductance matching section 102 and the substrate 500 by use of a fixing method such as adhesion. The exposing part 201 is electrically connected with the substrate 500. The internal conductor 204 of the coaxial cable 200 is fixed to the power supply section 104 while being electrically connected with the power supply section 104 through soldering, welding etc. The external conductor 203 of the coaxial cable 200 is fixed to the internal ground 103 while being electrically connected with the internal ground 103 through soldering, welding etc.

(Characteristics of Antenna Device 10)

Figure 6:
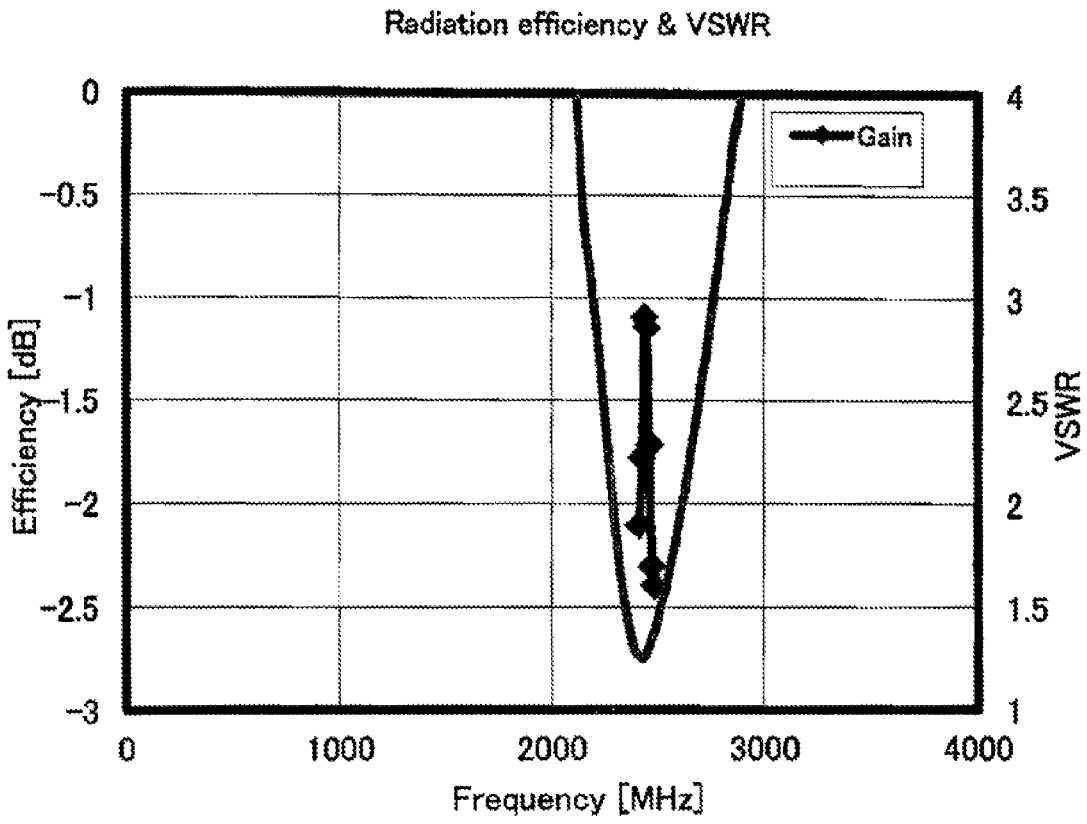
FIG. 6 is a graph illustrating radiation characteristics of an antenna device in accordance with the embodiment.
Figure 7:
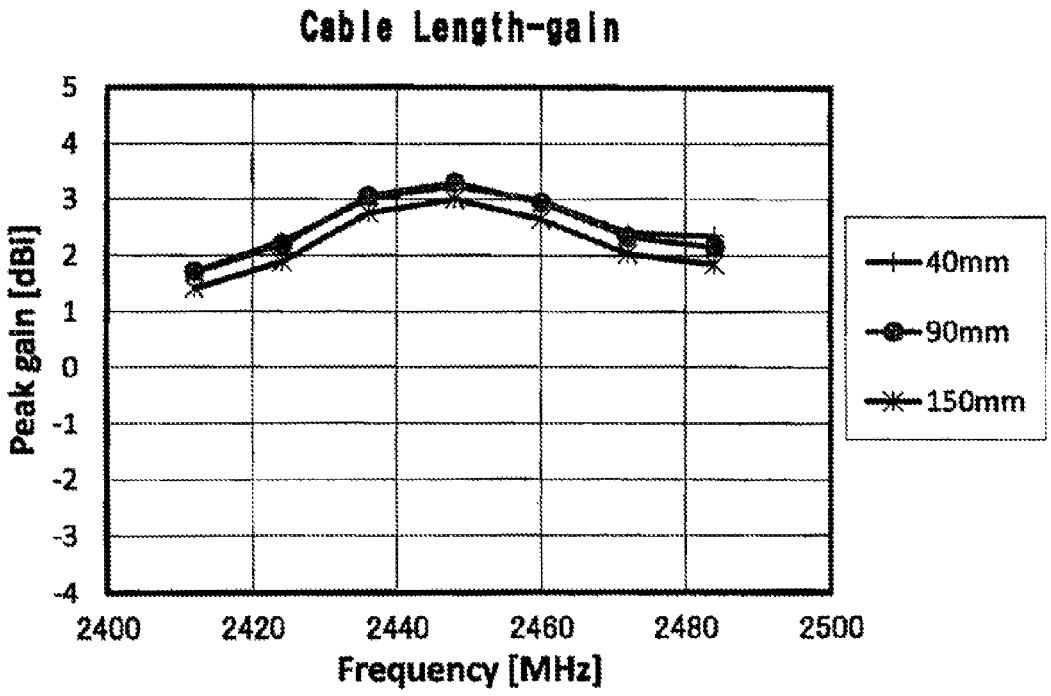
FIG. 7 is a graph illustrating a relation between a cable length of a coaxial cable and radiation characteristics in an antenna device in accordance with the embodiment.

With reference to FIGS. 6 and 7, the following description will discuss characteristics of the antenna device 10 in accordance with the embodiment.

FIG. 6 is a graph illustrating radiation characteristics of the antenna device 10 in accordance with the embodiment. The graph shows a measured gain and a measured VSWR characteristic of the antenna device 10.

As is clear from the measured results, the antenna device 10 in accordance with the present embodiment (i) has an operating band ranging from 2412 MHz to 2482 MHz and (ii) operates omnidirectionally at a central frequency of the operating band and obtains sufficient gain.

FIG. 7 is a graph illustrating a relation, in the antenna device 10 in accordance with the present embodiment, between a cable length of the coaxial cable 200 and radiation characteristics. Note that the radiation characteristics were measured in cases where the cable length of the coaxial cable 200 was 40 mm, 90 mm, and 150 mm.

According to the measured results, even in a case where the cable length of the coaxial cable 200 was any of 40 mm, 90 mm, and 150 mm, similar gains were obtained in individual frequencies of the operating band (ranging from 2412 MHz to 2482 MHz). This shows that the cable length of the coaxial cable 200 does not affect the radiation characteristics of the antenna device 10. That is, according to the antenna device 10, it is not necessary to take the cable length of the coaxial cable 200 into consideration when designing the antenna device 10. As such, a high degree of freedom in design is achieved.

Figure 8:
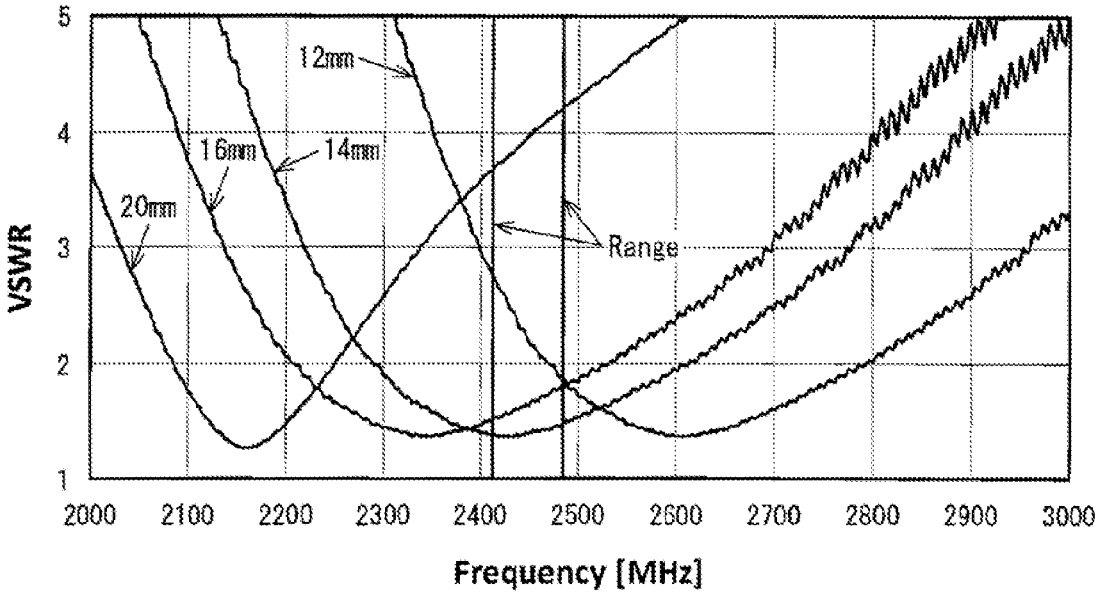
FIG. 8 is a graph illustrating a VSWR characteristic of an antenna device in accordance with the embodiment.

FIG. 8 is a graph illustrating a VSWR characteristic of the antenna device 10 in accordance with the embodiment. The graph shows a VSWR characteristic of the antenna device 10 measured in cases where the distance between the internal ground 103 and the exposing part 201 was 12 mm, 14 mm, 16 mm, and 20 mm.

As is clear from the measured results, the operating band can be shifted toward the lower frequency side, as the distance between the internal ground 103 and the exposing part 201 is longer (i.e. as the exposing part 201 is distanced farther from the internal ground 103). That is, the antenna device 10 can easily employ a desired band as the operating band, by adjusting the distance between the internal ground 103 and the exposing part 201.

As is clear from the measured results, a satisfactory VSWR characteristic (VSWR value becomes 3 or less) can be obtained, in a case where (i) the operating band is 2.4 GHz band (ranging from 2412 MHz to 2482 MHz) and (ii) the distance between the internal ground 103 and the exposing part 201 is not less than 12 mm and not more than 18 mm. Generally speaking, as is clear from the measured results, a satisfactory VSWR characteristic can be obtained when the distance between the internal ground 103 and the exposing part 201 is not less than $\lambda/10$ and not more than $\lambda/7$, where $\lambda$ is the operating wavelength. This is because a wavelength $\lambda_{2.4G}$ corresponding to 2.4 GHz is 125 mm and 12 mm$\approx\lambda_{2.4G}/10$ and 18 mm$\approx\lambda_{2.4G}/7$.

As is clear from the measured results, a more satisfactory VSWR characteristic is obtained when the distance between the internal ground 103 and the exposing part 201 is within ¼ of the wavelength of the operating band of the antenna device 10.

Figure 9:
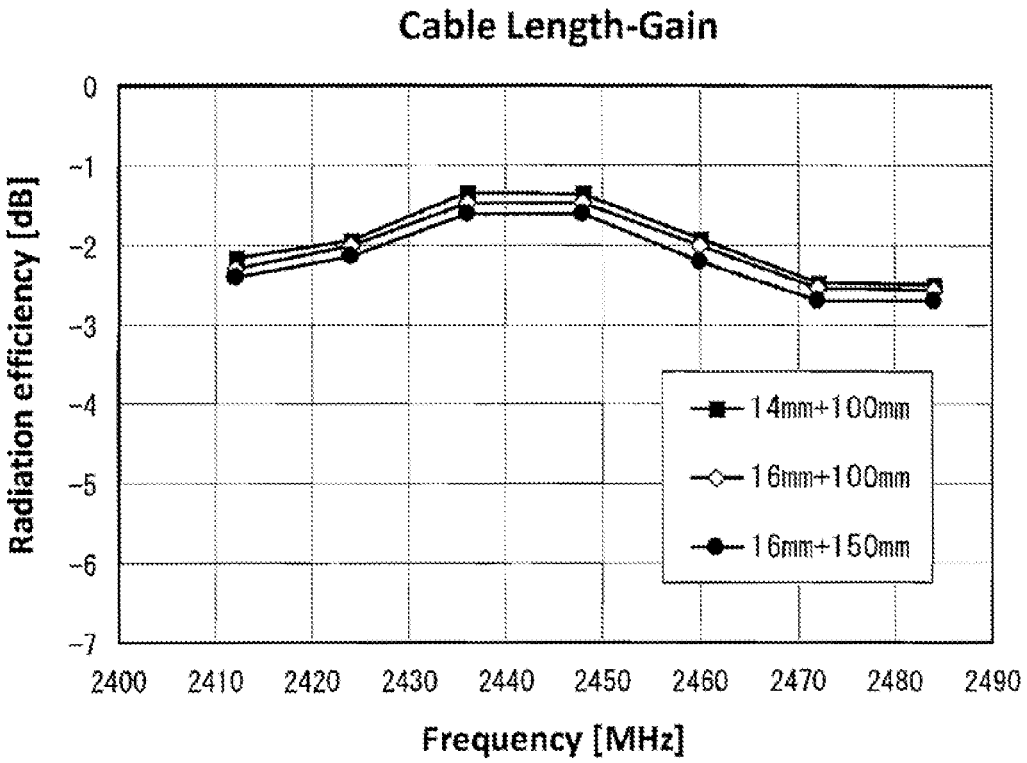
FIG. 9 is a graph illustrating a relation among the position of an exposing part, the cable length of a coaxial cable, and radiation characteristics in an antenna device in accordance with the embodiment.

FIG. 9 is a graph illustrating a relation among the location of the exposing part 201, the cable length of the coaxial cable 200, and the radiation characteristics in the antenna device 10 in accordance with the embodiment. The graph shows the radiation characteristics measured in the following three cases (1) through (3): (1) a case where the distance between the internal ground 103 and the exposing part 201 was 14 mm and the cable length of the coaxial cable 200 was 100 mm; (2) a case where the distance between the internal ground 103 and the exposing part 201 was 16 mm and the cable length of the coaxial cable 200 was 100 mm; and (3) a case where the distance between the internal ground 103 and the exposing part 201 was 16 mm and the cable length of the coaxial cable 200 was 150 mm.

As is clear from measured results, even in any of the cases (1) through (3), similar gains were obtained at individual frequencies of the operating band (ranging from 2412 MHz to 2482 MHz). This shows that the position of the exposing part 201 and the cable length of the coaxial cable 200 hardly affect gains obtained by the antenna device 10. That is, as long as the position of the exposing part 201 is within a range that allows employing a desired frequency band as the operating band, it is unnecessary to consider the position of the exposing part 201 in terms of other aspects and the cable length of the coaxial cable 200, when designing the antenna device 10 in accordance with the present embodiment. As such, a high degree of freedom in design is achieved.

Figure 10:
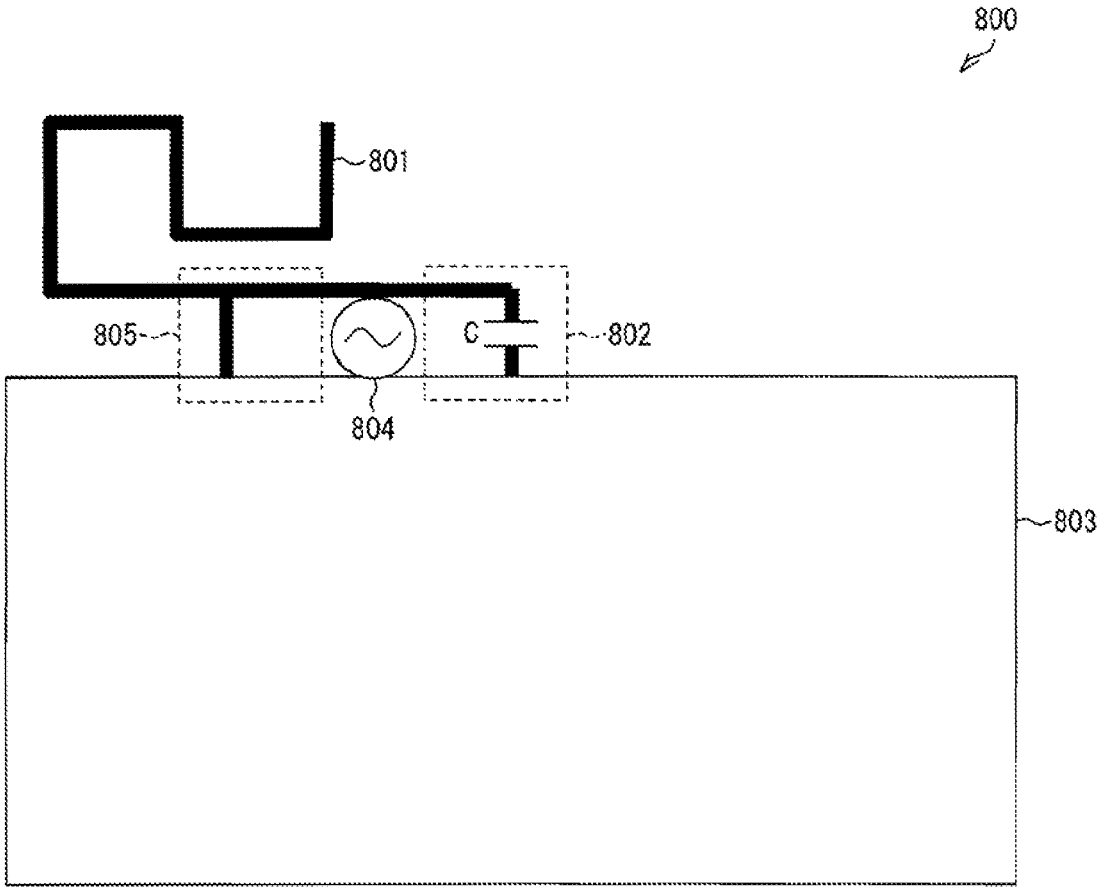
FIG. 10 schematically illustrates a configuration of an antenna device.

FIG. 10 schematically illustrates a configuration of the antenna device 10. An antenna 800 illustrated in FIG. 10 has a substantially equivalent configuration to that of the antenna device 10.

In the antenna 800 illustrated in FIG. 10, a radiating element 801 corresponds to the radiating element 101, a ground 803 corresponds to the internal ground 103 and the substrate (external ground) 500, and a power supply section 804 corresponds to the power supply section 104. A path 805 which short-circuits the radiating element 801 and the ground 803 corresponds to the short-circuit section 105, and a path 802 from the radiating element 801 to a capacitor C corresponds to the inductance matching section 102. The capacitor C corresponds to a capacitor between the inductance matching section 102 and the external conductor 203 of the coaxial cable 200, i.e. a capacitor between the inductance matching section 102 and the substrate 500.

Therefore, by measuring radiation characteristics of the antenna 800 in each of cases where the path 802 exists and where the path 802 does not exist, it is possible to obtain results similar to results obtained when radiation characteristics of the antenna device 10 are measured in each of cases where the inductance matching section 102 exists and where the inductance matching section 102 does not exist.

Figure 11:
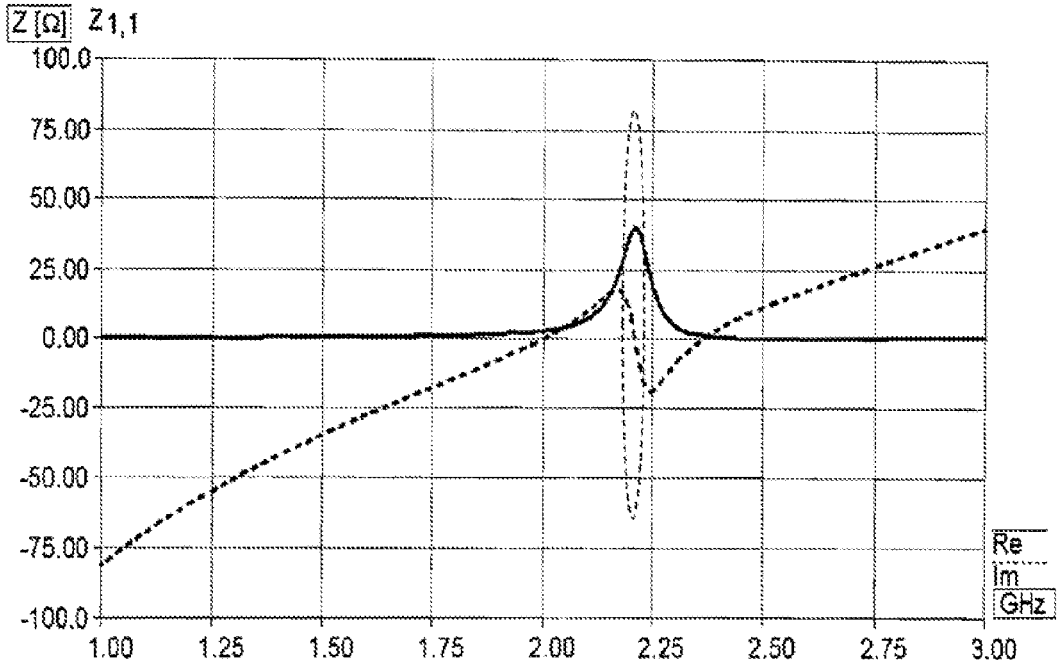
FIG. 11 is a graph illustrating input impedance of an antenna in a case where one short-circuit section is provided.
Figure 12:
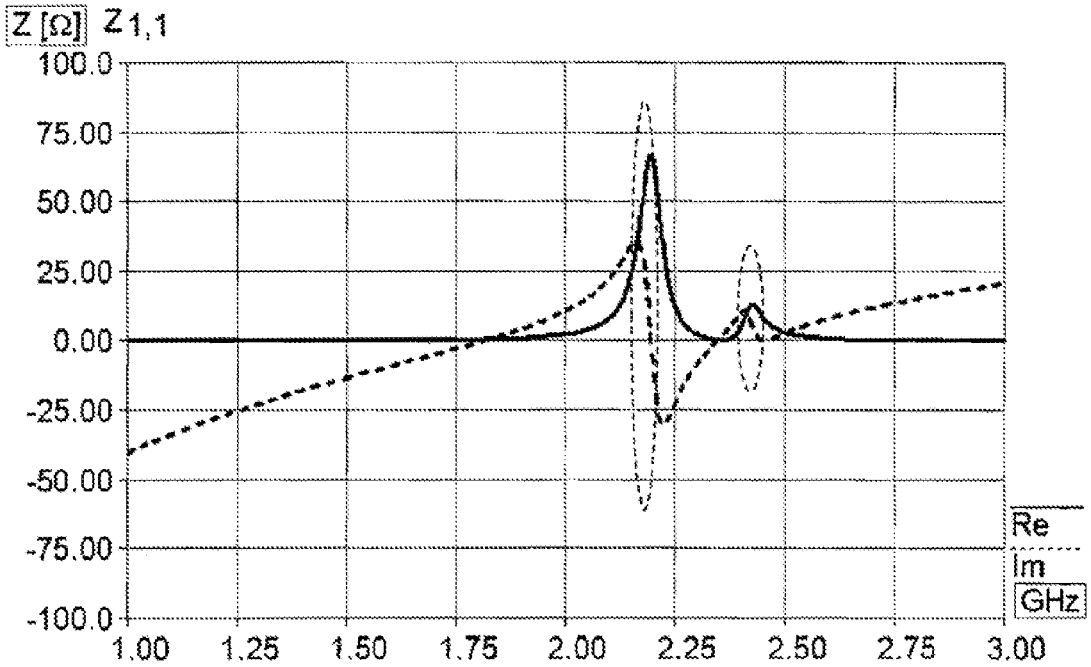
FIG. 12 is a graph illustrating input impedance of an antenna in a case where two short-circuit sections are provided.
Figure 13:
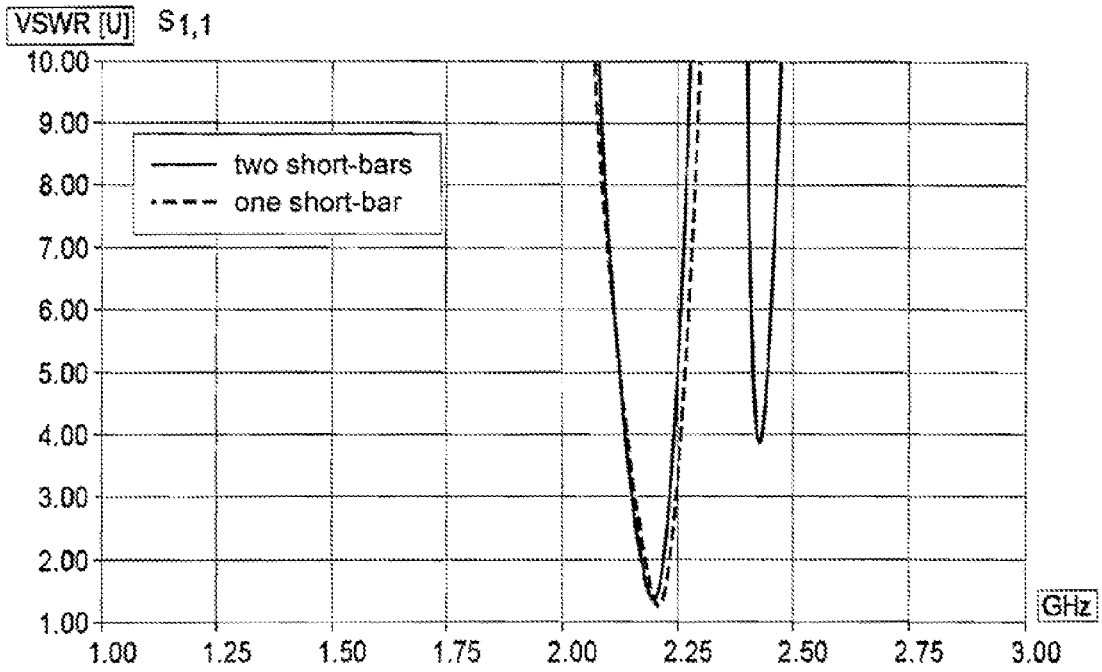
FIG. 13 is a graph illustrating a VSWR characteristic of an antenna.

FIGS. 11 to 13 are graphs illustrating the radiation characteristics of the antenna 800. In particular, FIG. 11 is a graph illustrating input impedance of the antenna 800 in a case where one short-circuit section (only the path 805) is provided. FIG. 12 is a graph illustrating input impedance of the antenna 800 in a case where two short-circuit sections (paths 805 and 802) are provided. FIG. 13 is a graph illustrating a VSWR characteristic of the antenna 800.

The results of the measurements illustrated in FIGS. 11 and 12 show that in the case where one short-circuit section is provided, one resonance point appears, and in the case where two short-circuit sections are provided, two resonance points appear. This shows that the operating band of the antenna 800 varies depending on whether one short-circuit section is provided or two short-circuit sections are provided, as illustrated in FIG. 13. Furthermore, it is found that in the case where two short-circuit sections are provided, appropriate adjustment of individual resonance points by changing sizes etc. of individual short-circuit sections allows widening the operating band.

These results of the measurements demonstrate that the operating band of the antenna device 10 can be further widened by providing not only the short-circuit section 105 but also the inductance matching section 102 if necessary.

(Effects)

As has been described, the antenna device 10 in accordance with the present embodiment employs a configuration in which the external conductor 203 of the coaxial cable 200 is connected with the substrate 500 so that the substrate 500 serves as an external ground of the antenna 100.

This configuration allows the antenna device 10 in accordance with the present embodiment to minimize the internal ground 103 directly connected with the external conductor 203 of the coaxial cable 200, without limiting an operation of the antenna device 10 as an inverted F antenna.

Consequently, the antenna device 10 in accordance with the present embodiment can be easily provided on a narrow space of a communication terminal on which the antenna device 10 is to be mounted. This makes it unnecessary to enlarge the space where the antenna device 10 is to be mounted, so that the antenna device 10 does not affect the design of the communication terminal.

Furthermore, the antenna device 10 in accordance with the present embodiment employs a configuration in which the radiating element 101 and the external conductor 203 of the coaxial cable 200 are capacitive-coupled with each other via the inductance matching section 102. As a result of this configuration, inductance occurs, and use of the inductance allows the antenna 100 to have a widened operating band and to have a sufficient VSWR characteristic.

Furthermore, the antenna device 10 in accordance with the present embodiment has a configuration in which the operating band of the antenna 100 is determined depending on the position of the exposing part 201 with respect to the internal ground 103. Therefore, by appropriately adjusting the position of the exposing part 201 with respect to the internal ground 103, it is possible to easily obtain a desired operating band.

It should be noted that the antenna device 10 in accordance with the present embodiment does not require a component to be added to a configuration of a conventional antenna device and has a relatively simple configuration. Accordingly, the antenna device 10 yields the various effects mentioned above, without increasing costs.

Furthermore, the antenna device 10 in accordance with the present embodiment can be provided inside a communication terminal on which the antenna device 10 is to be mounted, without distancing the antenna device 10 from members which inhibit radiation in a conventional antenna device, such as a print substrate, a metal housing, metal members, and electronic members. Even when the antenna device 10 is provided in such a way, appropriately adjusting the position of the exposing part 201 with respect to the internal ground 103 allows preventing decrease in radiation characteristics. Also in this regard, the antenna device 10 in accordance with the present embodiment can be easily provided on a narrow space of a communication terminal on which the antenna device 10 is to be mounted. This makes it unnecessary to enlarge the space where the antenna device 10 is to be mounted, so that the antenna device 10 does not affect the design of the communication terminal.

[Summary]

As has been described, the antenna device in accordance with the present embodiment includes: an antenna including a radiating element and an internal ground; a coaxial cable whose internal conductor is connected with the radiating element and whose external conductor is connected with the internal ground; and an external ground connected with the external conductor of the coaxial cable.

With the arrangement, both of the internal ground and the external ground serve as a ground (bottom board) which is an essential component of a monopole antenna (including an inverted F antenna). Therefore, for example, by using, as the external ground, a substrate originally included in a wireless device including the antenna device, it is possible to reduce the area of the internal ground without limiting a function of a monopole antenna. This allows realizing an antenna whose mounting area is smaller than that of a conventional antenna.

It is preferable to arrange the antenna device such that the antenna, which is an inverted F antenna, further includes a short-circuit section for short-circuiting the radiating element and the internal ground.

With the arrangement, it is possible to easily perform impedance matching between the antenna and the coaxial cable.

It is preferable to arrange the antenna device such that the radiating element includes: a first straight line section extending from a power supply section in a direction opposite to a direction in which the coaxial cable is drawn out, the power supply section being connected with the internal conductor of the coaxial cable; and a second straight line section connected via a first intermediary section with an end of the first straight line section which end is farther from the power supply section and extending from the first intermediary section in the direction in which the coaxial cable is drawn out, and the short-circuit section includes: a third straight line section extending from the power supply section in the direction opposite to the direction in which the coaxial cable is drawn out; and a fourth straight line section connected via a second intermediary section with an end of the third straight line section which end is farther from the power supply section and extending from the second intermediary section in the direction in which the coaxial cable is drawn out, and an end of the fourth straight line section which end is farther from the second intermediary section is connected with the internal ground.

With the arrangement, the antenna can be more compact. This allows realizing an antenna having a smaller mounting area.

It is preferable to arrange the antenna device such that the antenna further includes an inductance matching pattern which is connected with the radiating element and which is capacitive-coupled with the external conductor of the coaxial cable.

With the arrangement, as a result of capacitive coupling between the antenna and the coaxial cable, it is possible to cause inductance to occur between the antenna and the coaxial cable. By making use of a resonance at a resonance point of the inductance, it is possible to widen the operating band and improve the radiation characteristics.

It is preferable to arrange the antenna device in accordance with the present such that the inductance matching pattern has a width equal to or larger than a width of the coaxial cable which is provided on the inductance matching pattern.

With the arrangement, it is possible to easily perform inductance matching between the antenna and the coaxial cable.

It is preferable to arrange the antenna device such that a leading end of the radiating element and a leading end of the inductance matching pattern are juxtaposed.

With the arrangement, the position of the leading end of the radiating element is substantially equal to the position of the leading end of the inductance matching pattern, so that a radiation efficiency of the antenna can be increased.

It is preferable to arrange the antenna device such that a location where the external conductor of the coaxial cable is connected with the external ground is set in accordance with an operating band in which the antenna operates.

With the arrangement, by simply adjusting the location where the external conductor of the coaxial cable is connected with the external ground, it is possible to easily obtain a desired operating band. Furthermore, since an operating band according to an application purpose of the antenna can be obtained without changing a configuration of the antenna, it is possible to improve versatility of the antenna.

It is preferable to arrange the antenna device in accordance with the present such that a length between (i) a point where the external conductor of the coaxial cable is connected with the internal ground and (ii) a point where the external conductor of the coaxial cable is connected with the external ground is set to be within ¼ of a wavelength of the operating band of the antenna.

With the arrangement, by setting the length between the two points to be within ¼ of a wavelength of a desired operating band, it is possible to obtain a more satisfactory VSWR characteristic at the operating band.

An antenna mounting method in accordance with the present embodiment is an antenna mounting method for mounting, on a wireless device, an antenna including a radiating element and an internal ground, said antenna mounting method comprising the steps of: connecting an internal conductor of a coaxial cable with the radiating element and connecting an external conductor of the coaxial cable with the internal ground; and connecting the external conductor of the coaxial cable with an external ground included in the wireless device.

With the antenna mounting method, both of the internal ground and the external ground serve as a ground (bottom board) which is an essential component of a monopole antenna (including an inverted F antenna). Therefore, for example, by using, as the external ground, a substrate originally included in the wireless device, it is possible to reduce the area of the internal ground to be mounted on the wireless device, without limiting a function of a monopole antenna. This allows mounting, on the wireless device, an antenna whose mounting area is smaller than that of a conventional antenna.

[Additional Description]

The present invention is not limited to the description of the embodiments above, but may be altered by a skilled person within the scope of the claims. An embodiment based on a proper combination of technical means disclosed in different embodiments is encompassed in the technical scope of the present invention.

For example, embodiments obtained by changing the kind of the antenna, the structure of the antenna, the shape of the antenna, the size of the antenna, the operating band of the antenna etc. in the above embodiments are also encompassed in the technical scope of the present invention.

In the above embodiments, the description has dealt with an example in which the present invention is applied to an inverted F antenna. However, the present invention is not limited to this, and may be applied to various antennas such as a monopole antenna.

Furthermore, in the above embodiments, the description has dealt with an example in which the present invention is applied to an antenna having one radiating element. However, the present invention is not limited to this case, and may be applied to an antenna having two or more radiating elements (e.g. an antenna having a radiating element for low frequency and a radiating element for high frequency).

In either case, by appropriately changing the shape, the size, the position, the layout, the material etc. of individual sections (e.g. radiating element, internal ground, power supply section, short-circuit section, coaxial cable, and conductor) according to necessity, the operating band of the antenna can be broadened so that a target frequency band becomes the operating band, without enlarging the size of the antenna, similarly with the antenna device 10 in accordance with the embodiment.

INDUSTRIAL APPLICABILITY

The antenna device and the antenna mounting method of the present invention are applicable to various wireless devices which carry out wireless communications using an antenna device, and are particularly suitable for use in wireless devices such as smart phones, mobile phones, and electronic book readers etc. whose operating bands are broadening and which are required of downsizing and having good design.

REFERENCE SIGNS LIST

10 Antenna device
100 Antenna
101 Radiating element
102 Inductance matching section (inductance matching pattern)
103 Internal ground
104 Power supply section
105 Short-circuit section
106 Dielectric substrate
200 Coaxial cable
201 Exposing part
202 Coverture
203 External conductor
204 Internal conductor
205 Insulator
400 Housing
500 Substrate (external ground)

The invention claimed is:

1. An antenna device, comprising:

an antenna including a radiating element and an internal ground;

a coaxial cable whose internal conductor is connected with the radiating element and whose external conductor is connected with the internal ground; and an external ground connected with the external conductor of the coaxial cable, wherein the antenna, which is an inverted F antenna, further includes a short-circuit section for short-circuiting the radiating element and the internal ground, wherein the radiating element includes:

a first straight line section extending from a power supply section in a direction opposite to a direction in which the coaxial cable is drawn out, the power supply section being connected with the internal conductor of the coaxial cable; and a second straight line section connected via a first intermediary section with an end of the first straight line section which end is farther from the power supply section and extending from the first intermediary section in the direction in which the coaxial cable is drawn out, and wherein the short-circuit section includes:

a third straight line section extending from the power supply section in the direction opposite to the direction in which the coaxial cable is drawn out; and a fourth straight line section connected via a second intermediary section with an end of the third straight line section which end is farther from the power supply section and extending from the second intermediary section in the direction in which the coaxial cable is drawn out, and an end of the fourth straight line section which end is farther from the second intermediary section is connected with the internal ground.

2. The antenna device as set forth in claim 1, wherein the antenna further includes an inductance matching pattern which is connected with the radiating element and which is capacitive-coupled with the external conductor of the coaxial cable.

3. The antenna device as set forth in claim 2, wherein the inductance matching pattern has a width equal to or larger than a width of the coaxial cable which is provided on the inductance matching pattern.

4. The antenna device as set forth in claim 2, wherein a leading end of the radiating element and a leading end of the inductance matching pattern are juxtaposed.

5. The antenna device as set forth in claim 1, wherein a location where the external conductor of the coaxial cable is connected with the external ground is set in accordance with an operating band in which the antenna operates.

6. The antenna device as set forth in claim 1, wherein a length between (i) a point where the external conductor of the coaxial cable is connected with the internal ground and (ii) a point where the external conductor of the coaxial cable is connected with the external ground, is set to be within ¼ of a wavelength of the operating band of the antenna.

7. An antenna mounting method for mounting, on a wireless device, an antenna including a radiating element and an internal ground, said antenna mounting method comprising the steps of:

connecting an internal conductor of a coaxial cable with the radiating element and connecting an external conductor of the coaxial cable with the internal ground; and connecting the external conductor of the coaxial cable with an external ground included in the wireless device, wherein the antenna, which is an inverted F antenna, further includes a short-circuit section for short-circuiting the radiating element and the internal ground, wherein the radiating element includes:

a first straight line section extending from a power supply section in a direction opposite to a direction in which the coaxial cable is drawn out, the power supply section being connected with the internal conductor of the coaxial cable; and a second straight line section connected via a first intermediary section with an end of the first straight line section which end is farther from the power supply section and extending from the first intermediary section in the direction in which the coaxial cable is drawn out, and wherein the short-circuit section includes:

a third straight line section extending from the power supply section in the direction opposite to the direction in which the coaxial cable is drawn out; and a fourth straight line section connected via a second intermediary section with an end of the third straight line section which end is farther from the power supply section and extending from the second intermediary section in the direction in which the coaxial cable is drawn out, and an end of the fourth straight line section which end is farther from the second intermediary section is connected with the internal ground.

* * * * *